United States Patent [19]

Schelleng

[11] 4,389,241

[45] Jun. 21, 1983

[54] PROCESS FOR PRODUCING LITHIUM-METAL MASTER ALLOY

[75] Inventor: Robert D. Schelleng, Suffern, N.Y.

[73] Assignee: Novamet, Inc., Wyckoff, N.J.

[21] Appl. No.: 412,546

[22] Filed: Aug. 30, 1982

[51] Int. Cl.[3] ..... C22C 1/04; C22C 21/20

[52] U.S. Cl. ..... 75/0.5 R; 420/590

[58] Field of Search ..... 75/0.5 R, 0.5 B; 420/590

[56] References Cited

U.S. PATENT DOCUMENTS

| | | | |
|---|---|---|---|
| 3,563,730 | 2/1971 | Bach et al. | 75/135 |
| 3,591,362 | 7/1971 | Benjamin | 75/0.5 BA |
| 3,816,080 | 6/1974 | Bomford et al. | 29/182.5 |
| 3,957,532 | 5/1976 | Settle | 75/0.5 B |

*Primary Examiner*—W. Stallard

*Attorney, Agent, or Firm*—Francis J. Mulligan, Jr.; Raymond J. Kenny

[57] ABSTRACT

Master alloys of lithium or other alkali metal with a second metal such as alumium are made by exposing mechanically aloyed powder of the second metal to molten alkali metal. The exposure can be in an inert liquid medium such as a high boiling point hydrocarbon or in a dry, inert gas medium. In order that contact between the lithium and the second metal be efficient, significant, shear inducing agitation is required when the process is carried out in a liquid medium and kneading action, either manual or mechanical is required when the process is carried out dry in an inert gas medium.

6 Claims, No Drawings

PROCESS FOR PRODUCING LITHIUM-METAL MASTER ALLOY

HISTORY OF THE ART AND PROBLEM

Master alloys of lithium in powder form are useful in the process of manufacturing lithium-containing alloys especially by the process of mechanical alloying. For general information regarding mechanical alloying, reference is made to the Benjamin U.S. Pat. No. 3,591,362. With respect to mechanical alloying of aluminum alloys, background information is contained in the Bomford and Benjamin U.S. Pat. No. 3,816,080. Master alloys of lithium and other alkaki metals in powder form are also useful in other arts such as chemical reduction, catalysis and the like. In so far as applicant is aware, alkali metal master alloys have been made commercially by one of two processes. In the first process the alkali metal (hereinafter referred to as "lithium" for disclosure purposes) and a second metal (hereinafter referred to as "aluminum" for disclosure purposes) are melted together under appropriate conditions, cast and the cast billet is then crushed to form powder. This process has the disadvantages that for practical purposes only those master alloys, can be made which are brittle i.e., adapted to be crushed and secondly only those master alloys can readily be made which melt at temperatures where there is little or no volatilization loss of lithium. Metallic sodium, for example bolts at 892° C., metallic potassium boils at 774° C. and metallic cesium boils at 690° C., all at atmospheric pressure. Consequently practical production of master alloys of these elements melting at some significnt fraction or higher of the boiling point of the alkali metal presents practical problems solvable only by sophisticated melting and casting equipment and costly techniques.

In the second commercial process, believed to be described in the Bach et al U.S. Pat. No. 3,563,730, aluminum powder and lithium are dispersed in a high boiling point, inert organic liquid, e.g., a hydrocarbon oil and heated to a temperature above the melting point of lithium. The molten lithium is taken up by the aluminum powder after a period of time as disclosed in the Bach et al patent. Provided that the powder product is adequately washed free of the inert liquid and that control is maintained of composition, there are no deficiencies in this second commercial process except for the relatively long time required for the lithium to be taken up by the aluminum powder.

Very recently a patent application has been filed in the U.S. by coworkers of the inventor named herein under Ser. No. 396,892 Filing data July 9, 1982 (Inventors Erich, Varall and Donachie) disclosing a process wherein master alloy is made by exposing aluminum powder to molten lithium in a dry inert atmosphere such as argon. In this process, the aluminum powder and molten lithium are kneaded together until the lithium is taken up by the aluminum and a friable, clinker-like product is produced which can be readily powdered. Like the previously discussed liquid medium process, this newly disclosed process can produce a wide variety of compositions but takes a relatively long time for sorption of the lithium by the aluminum.

It is the principle object of the present invention to provide a means whereby the previously referenced second commercial process and the previously referenced newly disclosed process can be speeded up.

DESCRIPTION OF THE INVENTION

According to the present invention the previously referenced second commercial process and the previously referenced newly disclosed Erich et al, process, both of which involve the step of exposing molten lithium to powdered aluminum, can be speeded up by employing as the aluminum powder a mechanically alloyed aluminum powder.

The term "mechanically alloyed aluminum powder" means for purposes of this specification and claims a metal powder which has been subjected to processing as described in the aforementioned Benjamin U.S. Pat. No. 3,591,362 to provide a metal product which is essentially of saturation hardness, and, more particularly, of stable ultra-fine grain size. The mechanically alloyed metal powder may, as exemplified, be aluminum or an aluminum-rich alloy or aluminum or aluminum alloy containing an oxidic, carbidic or other dispersoid. In addition, the mechanically alloyed metal powder may be of any metal or metalloid suitable for combination with alkali metals. For example as disclosed in U.S. Pat. No. 3,563,730, the combining metal can be any one or more, or alloy, of aluminum, calcium, magnesium, barium, strontium, zinc, copper, manganese, tin, antimony bismuth, cadmium gold, silver, platinum, vanadium, indium, arsenic, silicon, boron, selenium, zirconium, tellurium and phosphorus. While the term "mechanically alloyed metal powder" is used in this specification to define the character of the powder, this term is not intended to imply the need for any significant alloy content. For purposes of this invention, it is believed that mechanical milling serves principally to introduce a fine dispersion of oxides and carbides and to reduce the grain size of the metal powder so as to produce large grain boundary areas which are stable during heating and through which lithium or other alkali metal can be absorbed by the secondary metal.

The temperature at which lithium is exposed to aluminum (generically any alkali metal to any secondary metal) is a temperature in excess of the melting point of the alkali metal and below the self-sintering temperature of the secondary metal or alloy. In the case of the previously referenced process of U.S. Pat. No. 3,563,730 wherein an inert liquid medium is used, the temperature at which exposure occurs also must be below the decomposition temperature of the liquid medium and, for simplicity sake, should be below the boiling point of the liquid medium. Of course when using the liquid medium, suitable precautions should be taken to avoid fire and explosion hazards and health hazards from fumes. In these regards one can employ an inert gas blanket over the liquid and suitable venting coupled with vapor recovery or flaming units.

BEST MODE OF CARRYING OUT THE INVENTION

An atomized aluminum powder of about 50 μm average particle size having a naturally occurring oxide film is subjected to milling in an attritor (a stirred ball mill) along with a conventional processing agent such as stearic acid until a "mechanically alloyed" powder is obtained having substantial saturation hardness along with a microfine grain size stabilized by the presence of oxide and carbide dispersoids.

This "mechanically alloyed" aluminum powder is then exposed to molten lithium in both the liquid medium process and the dry, inert atmosphere process. At temperatures roughly in the range of 200° C. to 300° C. lithium is rapidly taken up by the "mechanically alloyed" aluminum.

While in accordance with the provisions of the statute, there is illustrated and described herein specific embodiments of the invention. Those skilled in the art will understand that changes may be made in the form of the invention covered by the claims and that certain features of the invention may sometimes be used to advantage without a corresponding use of the other features.

The embodiments of the invention in which an exclusive property or privilege is claimed are defined as follows:

1. In the process of sorbing a molten alkali metal in and onto a powder of a secondary metal, the improvement comprising employing as said powder of said secondary metal a powder which has been subjected to mechanical milling so as to have achieved in said powder substantial saturation hardness and a stable microfine grain size.

2. A process as in claim 1 wherein the molten alkali metal is sorbed in and onto a powder of a secondary metal in the presence of an inert liquid phase.

3. A process as in claim 1 wherein the molten alkali metal is sorbed in and onto a powder of a secondary metal in the presence of an inert gaseous phase.

4. A process as in claim 1 wherein the alkali metal is lithium.

5. A process as in claim 1 wherein the secondary metal is selected from the group of aluminum and aluminum alloys.

6. A process as in claim 1 wherein the alkali metal is lithium and the secondary metal is selected from the group of aluminum and aluminum alloys.

* * * * *